US011766698B2

(12) United States Patent
Halladin et al.

(10) Patent No.: US 11,766,698 B2
(45) Date of Patent: Sep. 26, 2023

(54) VIBRATING SCREENING SYSTEM, COMPRISING AT LEAST TWO SCREENING MACHINES ARRANGED IN A ROW

(71) Applicant: SPALECK GMBH & CO. KOMMANDITGESELLSCHAFT, Bocholt (DE)

(72) Inventors: Jörg Halladin, Bocholt (DE); Simon Schmeink, Bocholt (DE)

(73) Assignee: SPALECK GMBH & CO. KOMMANDITGESELLSCHAFT, Bocholt (DE)

( * ) Notice: Subject to any disclaimer, the term of this patent is extended or adjusted under 35 U.S.C. 154(b) by 93 days.

(21) Appl. No.: 17/424,120

(22) PCT Filed: Jan. 28, 2020

(86) PCT No.: PCT/EP2020/025034
§ 371 (c)(1),
(2) Date: Jul. 19, 2021

(87) PCT Pub. No.: WO2020/156757
PCT Pub. Date: Aug. 6, 2020

(65) Prior Publication Data

US 2022/0097101 A1 Mar. 31, 2022

(30) Foreign Application Priority Data

Jan. 31, 2019 (DE) ..... 102019102436.6

(51) Int. Cl.
*B07B 1/34* (2006.01)
*B07B 1/42* (2006.01)
(Continued)

(52) U.S. Cl.
CPC ..... *B07B 1/46* (2013.01); *B07B 1/005* (2013.01); *B07B 1/34* (2013.01); *B07B 1/42* (2013.01); *B07B 2201/04* (2013.01)

(58) Field of Classification Search
CPC .... B07B 1/34; B07B 1/42; B07B 1/46; B07B 1/005; B07B 2201/04
(Continued)

(56) References Cited

U.S. PATENT DOCUMENTS 4,147,256 A * 4/1979 Kiss ..... A01M 5/00 209/635
4,855,039 A 8/1989 Genev
2022/0097100 A1* 3/2022 Halladin ..... B07B 1/46

FOREIGN PATENT DOCUMENTS

DE 1201160 B * 9/1965
DE 1201160 B 9/1965
(Continued)

OTHER PUBLICATIONS

International Search Report; priority document.

*Primary Examiner* — Terrell H Matthews
(74) *Attorney, Agent, or Firm* — Greer, Burns & Crain, Ltd.

(57) ABSTRACT

A vibrating screening system, made up of at least two screening machines configured in a row and that can be set into vibration, each screening machine having a resiliently supported screening material feed end and a resiliently supported screening material discharge end. All supports of the last screening machine, in the screening material conveying direction, are supported directly on the supporting surface. The support provided respectively in the region of the screening material feed end of any earlier screening machine in the conveying direction is likewise supported directly on the supporting surface. In each case, the support provided in the region of the screening material discharge
(Continued)

end of any such earlier screening machine in the conveying direction is supported in the region of the screening material feed end of the screening machine that is subsequent in the screening material conveying direction, on this subsequent machine.

12 Claims, 2 Drawing Sheets

(51) Int. Cl.
*B07B 1/46* (2006.01)
*B07B 1/00* (2006.01)

(58) Field of Classification Search
USPC ..... 209/311, 313, 314
See application file for complete search history.

(56) References Cited

FOREIGN PATENT DOCUMENTS

| | | | | | |
|---|---|---|---|---|---|
| DE | 3139279 | A1 | * | 4/1983 | |
| DE | 3139279 | A1 | | 4/1983 | |
| DE | 8512051 | U1 | | 8/1985 | |
| DE | 102012206347 | A1 | | 10/2013 | |
| EP | 316461 | A | * | 5/1989 | ..... B07B 1/46 |
| EP | 0316461 | A1 | * | 5/1989 | |
| EP | 0316461 | A1 | | 5/1989 | |

* cited by examiner

VIBRATING SCREENING SYSTEM, COMPRISING AT LEAST TWO SCREENING MACHINES ARRANGED IN A ROW

CROSS-REFERENCES TO RELATED APPLICATIONS

This application claims the benefit of the International Application No. PCT/EP2020/025034, filed on Jan. 28, 2020, and of the German patent application No. 102019102436.6 filed on Jan. 31, 2019, the entire disclosures of which are incorporated herein by way of reference.

FIELD OF THE INVENTION

The present invention relates to a vibrating screening system made up of at least two screening machines configured in a row and capable of being set into vibration, each screening machine having a screening material feed end and a screening material discharge end, and each screening machine having a respective resilient support in the region of its screening material feed end and in the region of its screening material discharge end.

BACKGROUND OF THE INVENTION

Screening machines per se have been known for decades, and are in wide use.

DE 85 12 051 U1, for example, indicates a screening device having a bearing construction that can be set into vibration that is supported on the supporting surface on springs, and has a vibration exciter. The bearing construction is made up of two side walls connected by first crossbeams, which walls preferably carry out a circular vibration, as well as second crossbeams that are connected to the bearing construction by springs and that vibrate elliptically or in the longitudinal direction, and an elastic screening mat being situated between each first and second crossbeam. The vibrating device can be set up having an inclination, so that an adequate conveying speed and a corresponding dwell time of the screening material on the screen is achieved.

DE 10 2012 206 347 A1 indicates a screening device having a base frame that can be set into vibration and that is made up of two side walls connected by first crossbeams, and having an additional frame connected to the base frame via spring elements, the additional frame being formed from two side beams configured parallel to the side walls and connected by second crossbeams, the first and second crossbeams alternating with one another, seen in the longitudinal direction of the screening device, and flexible screening mats, forming a screening surface, being clamped between each first and second crossbeam, and the additional frame being divided into at least two additional frame segments in the longitudinal direction. In addition, it is provided that the screening device, seen in its longitudinal direction, has at least two screening segments, situated one after the other, having different orientations relative to the horizontal, that each screening segment is assigned its own additional frame segment, and that each screening segment, in addition to the different orientation relative to the horizontal, differs from the other screening segment/segments in at least one further screening parameter. This is also a unified screening machine in which it is merely the case that screening machine regions having different inclinations are provided.

From practical use, it is also known to set up two or more conventional screening machines, independent of one another and individually mounted on the supporting surface, and to cause the screening material to be conveyed over the row of screening machines, if the screening task to be achieved makes this expedient or necessary.

In the known prior art, it is regarded as disadvantageous that in many cases the individual screening machines, and even more so row configurations of a plurality of screening machines, already have a very long constructive length, which makes the transport of the screening machines or vibrating screening systems from the manufacturer to the location of use complicated and expensive, and results in a large space requirement at the location of use.

SUMMARY OF THE INVENTION

For the present invention, an object therefore arises of providing a vibrating screening system of the type named above that avoids the indicated disadvantages, and that, in particular, simplifies transport from the manufacturer to the location of use, and has a smaller space requirement at the location of use.

According to the present invention, this object is achieved by a vibrating screening system of the type named above that is characterized in that all supports of the last screening machine in the row of screening machines, seen in the direction of conveyance of the screening material, are supported on the supporting surface, and that the support provided in the region of the screening material feed end of the/each further screening machine is also supported on the supporting surface, and that, in each case, the support provided in the region of the screening material discharge end of the/each further screening machine is supported in the region of the screening machine feed end of the following (in the direction of conveyance of the screening material) screening machine, on this screening machine.

Advantageously, in the vibrating screening system according to the present invention the distance between the individual screening machines can be reduced, and, in this way, a smaller size of the overall system can be achieved. The total weight of the vibrating screening system is reduced, and its energy efficiency is thereby increased. In addition, a reduced number of supports on the supporting surface is required, resulting in a lower outlay in the design and manufacture of support foundations at the supporting surface. In addition, the vibrating screening system according to the present invention has reduced sensitivity of the individual screening machines to being loaded by screening material, because the screening machines can transmit kinetic energy between themselves. This is advantageous, in particular, when there is a non-uniform distribution of heavy screening material. Due to the fact that the first screening machine in the row does not have to bear at its feed end any load of a predecessor, this machine has more conveying power, which promotes faster distribution of the screening material and reduces the sensitivity to loading. Due to the fact that the last (in the direction of conveyance of the screening material) screening machine is not excited at its discharge end by the upstream adjacent screening machine, the final screening machine of the row has a smaller vibration width at its screening material discharge end, so that a smaller distance becomes possible in the transfer to a following component of a screening material treatment system.

In order to simplify the transfer of screened material from a screening machine to the subsequent screening machine, it is further provided that, in each case, the screening material discharge end of screening machines situated before the last (seen in the conveying direction of the screening material)

screening machine is situated above the screening material feed end of the following (in the conveying direction) screening machine. Due to this configuration, as a rule no additional means are required for transferring the screening material, which further contributes to a weight-saving realization of the vibrating screening system. The step between the individual screening machines can be set and adjusted to different heights, corresponding to the needs of the situation. Advantageously, in addition, the screening material is loosened during the transfer by a certain falling distance and impact on the screening material feed region of the subsequent screening machine.

As needed, a screening material transfer chute may be respectively situated between the screening material discharge end of screening machines situated before (in the conveying direction) the last screening machine and the subsequent (in the conveying direction) screening machine, or at the screening material discharge end of each screening machine. The screening material transfer chute may advantageously be short and therefore light in weight.

In addition, the present invention provides that all supports are respectively formed by a spring system, and that, in each case, the spring system of the support provided in the region of the screening material discharge end of the/each further screening machine and the spring system of the support provided in the region of the screening material feed end of the following (in the conveying direction) screening machine are configured so as to be aligned one over the other. This achieves both a mechanically simple configuration and properties that are favorable with respect to the vibration.

Advantageously, it is possible for all the screening machines of the vibration screening system to be made identical to one another, which permits a low-cost modular construction of the vibrating screening system having more or fewer screening machines as needed.

Alternatively, the screening machines of the vibrating screening system may be realized differently from one another, if the screening tasks to be processed by the screening machine system require this or make it expedient. Here as well, a base construction, i.e., a substantial part, of the individual screening machines may be realized identical to one another, so that here as well an economical modular manufacture and design are achieved.

In order to make it possible to easily allocate different screening tasks to the individual screening machines within the screening machine system, it is provided that the screening machines of the screening machine system are realized having screens that have screen mesh sizes that differ from screening machine to screening machine, and/or that blind zones and/or distributing cones and/or material flow dividers are attached to the screening machines. For example, the screen mesh size can increase from screening machine to screening machine, seen in the conveying direction.

A further possibility for adjusting the vibrating screening system to the particular screening material to be processed with changing properties is achieved in that preferably a separate vibratory drive is allocated to each screening machine of the vibrating screening system.

In a further embodiment of the vibrating screening system, finally, it is provided that each vibratory drive is adjustable and operable individually in its rotational speed and/or its vibration angle and/or its vibration amplitude and/or its phase angle and/or its vibration pattern. In this way, during operation of the vibrating screening system a flexible, individual adaptation to different screening materials and screening tasks is enabled, thus permitting an optimization of the screening result.

BRIEF DESCRIPTION OF THE DRAWINGS

In the following, exemplary embodiments of the present invention are explained on the basis of a drawing.

In the following description of the Figures, identical parts in the various Figures of the drawing are always provided with the same reference characters, so that all reference characters do not have to be explained again for each Figure.

DETAILED DESCRIPTION OF THE PREFERRED EMBODIMENTS

Figure 1:
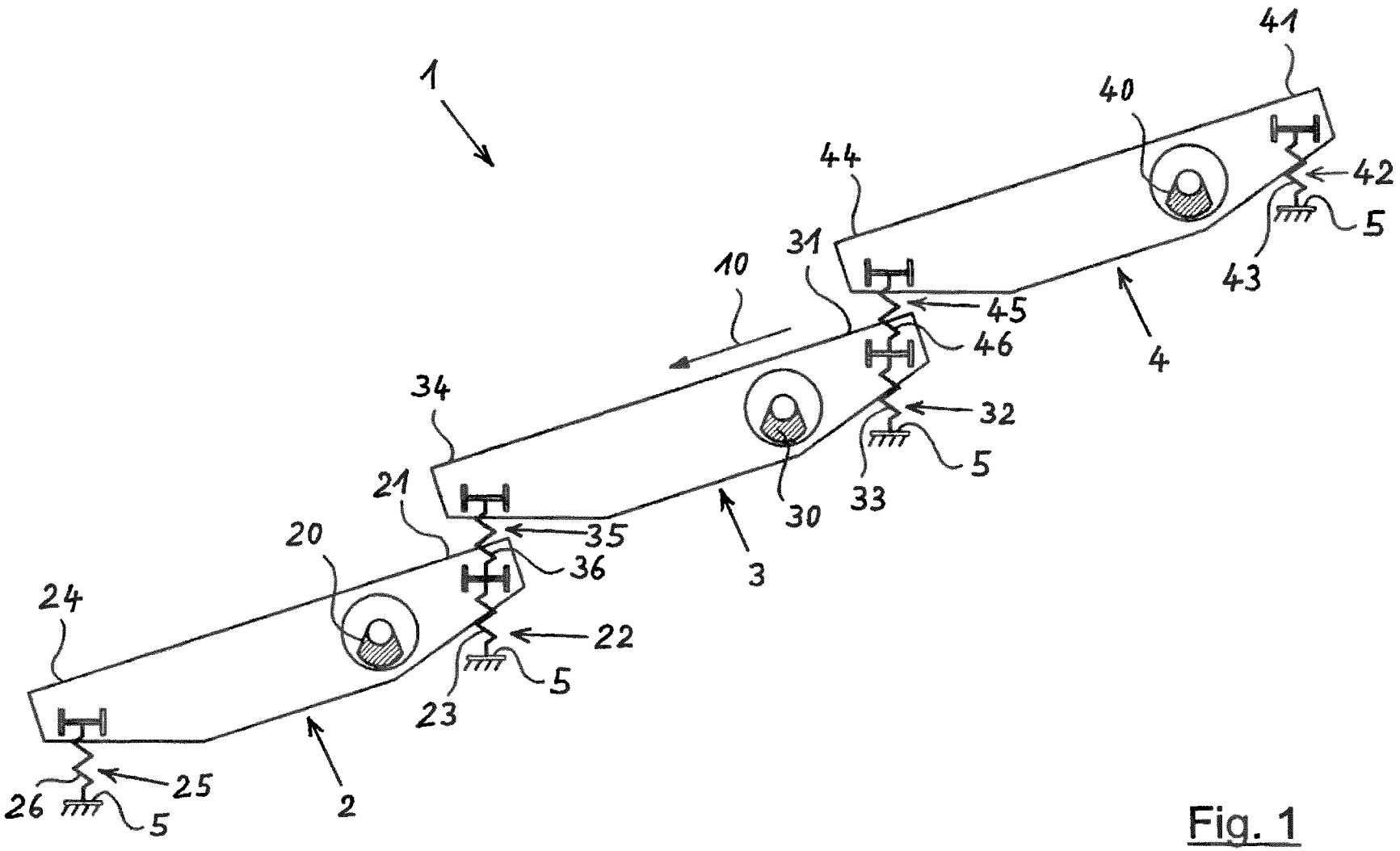
FIG. 1 shows a first vibrating screening system having three screening machines, in a schematic side view.

FIG. 1 shows a first vibrating screening system 1 in a schematic side view. Here, vibrating screening system 1 is made up of three screening machines 2, 3, 4 configured in a row and capable of being set into vibration by at least one respectively allocated vibratory drive 20, 30, 40. Vibratory drives 20, 30, 40 are of a known design, and are realized, e.g., having rotating imbalance masses, as shown in the drawing. Preferably, each vibratory drive 20, 30, 40 can be individually adjusted and operated in its rotational speed and/or its vibration angle and/or its vibration amplitude and/or its phase angle and/or its vibration pattern, in order to make it possible to optimally adapt vibrating screening system 1 to different screening materials and tasks.

Each screening machine 2, 3, 4 has a screening material feed end 21, 31, 41, each situated at the right in FIG. 1, and a screening material discharge end 24, 34, 44, each situated at the left. Screening material can be conveyed in screening material conveying direction 10 (indicated by an arrow) by vibrating screening system 1. Screening machines 2, 3, 4 each have at least one flat screen (not visible here) running perpendicular to the surface plane of the drawing, having a specifiable screen mesh size, by which, during operation of the vibrating screening system, those particles of the screening material that can fall through the screen mesh are screened out from the screening material.

In addition, each screening machine 2, 3, 4 has a respective resilient support 22, 25; 32, 35; 42, 45 in the region of its screening material feed end 21, 31, 41 and in the region of its screening material discharge end 24, 34, 44. All supports 22, 25 of the last (seen in conveying direction 10) screening machine 2 in the row of screening machines 2, 3, 4 are supported on supporting surface 5. Support 32, 42, respectively situated in the region of screening material feed end 31, 41 of each further screening machine 3, 4, (earlier in the conveying direction) is also supported on supporting surface 5.

However, the respective supports 35, 45 provided in the region of screening material discharge end 34, 44 of each further screening machine 3, 4 are not supported on supporting surface 5; rather, in the region of screening material feed end 21, 31 of the following (in conveying direction 10) (subsequent) screening machine 2, 3, they are supported on this subsequent machine.

All supports 22, 25; 32, 35; 42, 45 are here formed, in each case, by a spring system 23, 26; 33, 36; 43, 46. Here, in each case, spring system 36, 46 of support 35, 45 provided in the region of screening material discharge end 34, 44 of each further screening machine 3, 4, and spring system 23, 33 of support 22, 32 provided in the region of screening material feed end 21, 31 of the following (in conveying direction 10) screening machine 2, 3, are configured so as to be aligned one over the other. Spring systems 23, 26; 33, 36; 43, 46 are made up, for example, of steel springs or elastomer springs or pneumatic springs.

In each case, screening material discharge end 34, 44 of screening machines 3, 4 situated before (in conveying direction 10) the last screening machine 2 is situated above screening material feed end 21, 31 of the following (in conveying direction 10) screening machine 2, 3. The step between the individual screening machines 2, 3, 4 can be adapted to the particular requirements of the situation by attaching the elements of spring systems 36, 46 at different heights. The use of spring systems 36, 46 adjustable in their length is also possible for this purpose.

The angle of inclination of screening machines 2, 3, 4 relative to the horizontal, and the angle between the individual screening machines 2, 3, 4, can be set and adjusted so as to meet the needs of the particular situation by changing the height of supports 22, 25; 32, 35; 42, 45 relative to supporting surface 5.

All screening machines 2, 3, 4 of vibrating screening system 1 can be realized identically to one another, enabling a simple modular construction having different numbers of screening machines depending on the needs of the situation.

Alternatively, screening machines 2, 3, 4 of vibrating screening system 1 can be realized differently from one another. For example, screening machines 2, 3, 4 of vibrating screening system 1 can be realized having screens that have screen mesh sizes differing from screening machine 2, 3, 4 to screening machine 2, 3, 4, and/or blind zones and/or distributing cones and/or material flow dividers can be provided on screening machines 2, 3, 4 that are hidden and therefore not visible in the drawing, or are not shown separately because they are known per se.

During operation of vibrating screening system 1, screening material is fed onto screening material feed end 41 of first screening machine 4, situated at right in FIG. 1, e.g., by a conveyor belt. During the conveying of the screening material in conveying direction 10, portions of the screening material screened through the screen of the screening machine fall downward and are caught and/or transported away by suitable devices (not shown separately here). At screening material discharge end 24 of the last screening machine 2 of the row, a screening material residue, made up of larger screening material portions that do not fit through the screen mesh, is then discharged.

Figure 2:
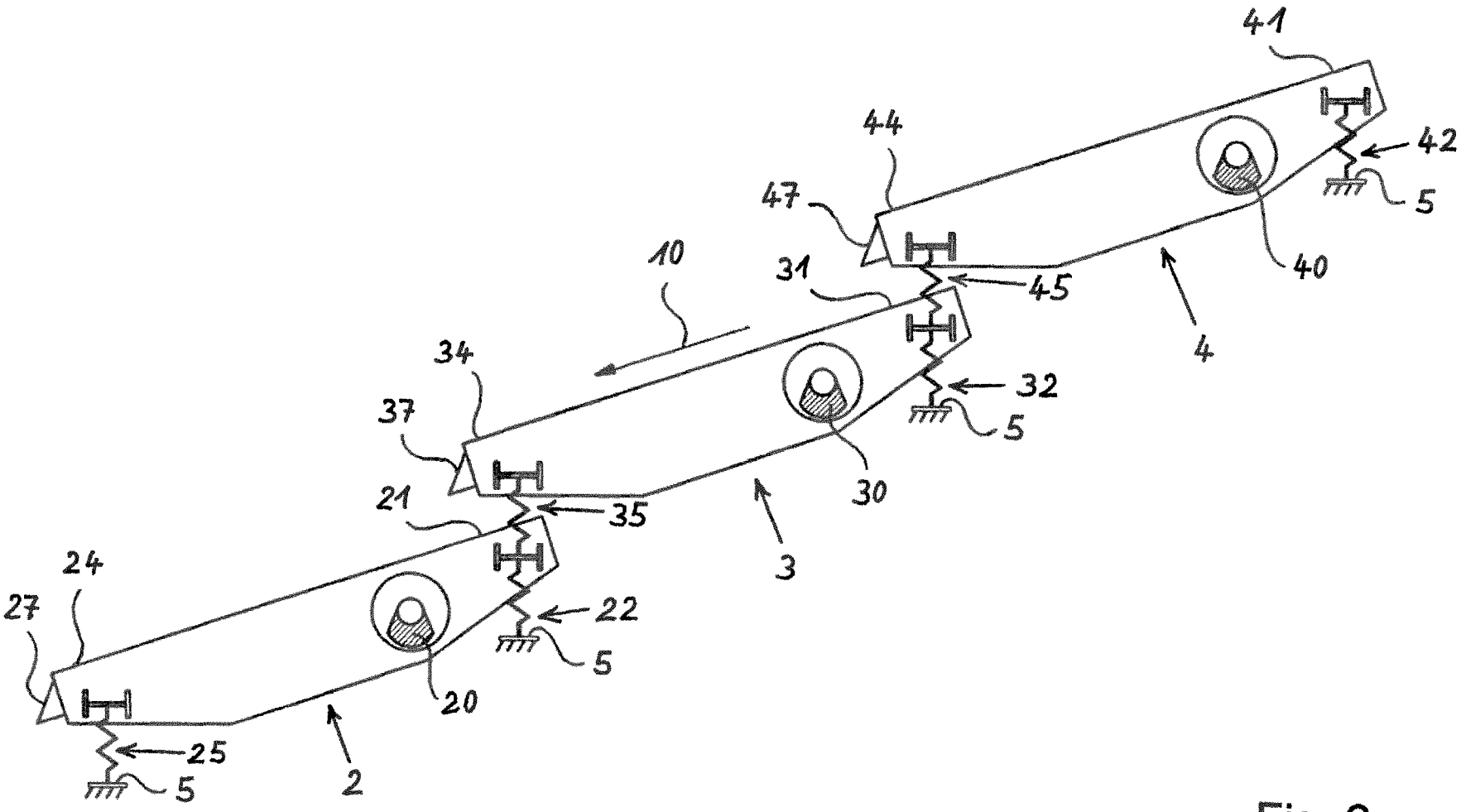
FIG. 2 shows a second vibrating screening system having three screening machines, also in a schematic side view.

FIG. 2 shows a second vibrating screening system 1 having three screening machines 2, 3, 4 configured in a row, also in a schematic side view.

Vibrating screening system 1 according to FIG. 2 differs from the above-described vibrating screening system 1 according to FIG. 1 in that at the screening material discharge end 24, 34, 44 of all screening machines 2, 3, 4, there is respectively situated a screening material transfer chute 27, 37, 47 that prevents loss of screening material to the surrounding environment, in particular, when lightweight screening material is being processed.

In its remaining parts, vibrating screening system 1 according to FIG. 2 corresponds to the above-described vibrating screening system 1 according to FIG. 1, to whose description reference is therefore made.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE CHARACTERS

1 vibrating screening system
10 screening material conveying direction
2 last screening machine
20 vibratory drive of 2
21 screening material feed end of 2
22 support on 21
23 spring system on 22
24 screening material discharge end of 2
25 support on 24
26 spring system on 25
27 transfer chute on 24
3 first further screening machine
30 vibratory drive of 3
31 screening material feed end of 3
32 support on 31
33 spring system on 32
34 screening material discharge end of 3
35 support on 34
36 spring system on 35
37 transfer chute on 34
4 second further screening machine
40 vibratory drive of 4
41 screening material feed end of 4
42 support on 41
43 spring system on 42
44 screening material discharge end of 4
45 support on 44
46 spring system on 45
47 transfer chute on 44
5 supporting surface

The invention claimed is:

1. A vibrating screening system, made up of at least two screening machines that are configured in a row of screening machines on a supporting surface and that can be set into vibration, each screening machine having a screening material feed end and a screening material discharge end, and each screening machine having a resilient support in a region of its screening material feed end and a resilient support in a region of its screening material discharge end, wherein all supports of a last screening machine, seen in a screening material conveying direction, in the row of screening machines, are supported directly on the supporting surface, and wherein the support provided respectively in the region of the screening material feed end of each earlier screening machine in the conveying direction, is likewise supported directly on the supporting surface, and wherein, in each case, the support provided in the region of the screening material discharge end of each said earlier screening machine in the conveying direction is not supported directly on the supporting surface, but rather is supported in the region of the screening material feed end of the screening machine that is subsequent in the screening material conveying direction, on this subsequent machine.

2. The vibrating screening system according to claim 1, wherein, in each case, the screening material discharge end of screening machines situated before, viewed in the screening material conveying direction, the last screening machine is situated above the screening material feed end of the following screening machine in the screening material conveying direction.

3. The vibrating screening system according to claim 1, wherein a respective screening material transfer chute is situated, in each case, between the screening material discharge end of screening machines situated before, seen in the screening material conveying direction, the last screening machine and the following screening machine in the screening material conveying direction, or at the screening material discharge end of each screening machine.

4. The vibrating screening system according to claim 1, wherein all supports are respectively formed by a spring system, and that, in each case, the spring system of the support provided in the region of the screening material discharge end of any additional screening machine and the spring system of the support provided in the region of the screening material feed end of the following screening machine in the screening material conveying direction are configured so as to be aligned one over the other.

5. The vibrating screening system according to claim 1, wherein all screening machines of the vibrating screening system are realized identically to one another.

6. The vibrating screening system according to claim 1, wherein the screening machines of the vibrating screening system are realized differently from one another.

7. The vibrating screening system according to claim 6, wherein the screening machines of the vibrating screening system are realized having screens that have screen mesh sizes that differ from screening machine to screening machine.

8. The vibrating screening system according to claim 6, wherein the screening machines of the vibrating screening system are realized having blind zones.

9. The vibrating screening system according to claim 6, wherein the screening machines of the vibrating screening system are realized having distributing cones.

10. The vibrating screening system according to claim 6, wherein the screening machines of the vibrating screening system are realized having material flow dividers.

11. The vibrating screening system according to claim 1, wherein at least one separate vibratory drive is allocated to each screening machine.

12. The vibrating screening system according to claim 11, wherein each vibratory drive is adjustable and operable individually with respect to at least one of a rotational speed, a vibration angle, a vibration amplitude, a phase angle, or a vibration pattern.

* * * * *